United States Patent [19]

Nomura et al.

[11] 4,332,226

[45] Jun. 1, 1982

[54] ENGINE CONTROL SYSTEM

[75] Inventors: Toshio Nomura, Shiki; Isao Kobayashi, Tokyo, both of Japan

[73] Assignee: Honda Giken Kogyo Kabushiki Kaisha, Tokyo, Japan

[21] Appl. No.: 210,918

[22] Filed: Nov. 28, 1980

[30] Foreign Application Priority Data

Dec. 28, 1979 [JP] Japan ..... 54/170417

[51] Int. Cl.[3] ..... F02M 5/02

[52] U.S. Cl. ..... 123/494; 123/478

[58] Field of Search ..... 123/478, 486, 487, 488, 123/492, 493, 494

[56] References Cited

U.S. PATENT DOCUMENTS 4,155,332 5/1979 Yaegashi et al. ..... 123/478 X

*Primary Examiner*—Tony M. Argenbright

*Attorney, Agent, or Firm*—Pollock, Vande Sande & Priddy

[57] ABSTRACT

An engine control system is disclosed which comprises a means for storing engine control data with such parameters as throttle valve opening angle for regulating the quantity of the air taken into an engine cylinder, an intake manifold depression and an engine speed, a means for reading-out said engine control data with the parameters of the intake manifold depression and the engine speed in light load condition and with the parameters of the throttle valve opening angle and the engine speed in heavy load condition, and a means for controlling the engine using the read-out data. The change of parameter in said system is achieved by using at least one of the throttle valve opening angle, intake manifold depression, engine speed and the engine control data. The locus or the valve of the changing point in parameter replacement from the intake manifold depression to the throttle valve opening angle, or vice versa, may have a hysteresis characteristic. Furthermore, said changing point may be shifted in response to the engine speed.

18 Claims, 15 Drawing Figures

|P|
G
H
θ
θth
PB
PB'
D
F
B
A
C
P2
P1
θ1
θ0
θ2
0
1/4
2/4
3/4
4/4
ENGINE LOAD

FUEL QUANTITY
θ1
θ2
θ'1
θ'2
n2 n1
ENGINE SPEED
ne

FUEL QUANTITY
P'1
P'2
P1
P2
n2 n1
ENGINE SPEED
ne

P1
P2
θ1
θ2
n2 n1
ENGINE SPEED
ne

PB
θth
D2
D1
ENGINE CONTROL DATA

ENGINE CONTROL SYSTEM

FIELD OF THE INVENTION

This invention relates to an engine control system.

DESCRIPTION OF THE PRIOR ART

For better engine operation and for harmful exhaust gas reduction, it is necessary to control the air-fuel ratio, ignition timing and EGR. To control these factors, mechanical devices such as evaporators and ignition timing control devices have been developed. Such conventional mechanical devices, however, had much difficulty in keeping up with the complicated variation of necessary fuel quantity and ignition timing related to the engine operating parameters. Although some devices were capable of doing so, they were complicated and expensive.

To overcome these difficulties, an electric control device has been proposed in which two parameters are chosen out of such engine operation parameters as throttle valve opening angle (termed θth below) for controlling the volume of the air taken into the engine cylinder, intake manifold depression (PB) of the engine, and the engine speed (ne), on one hand, and on the other hand other engine controlling factors (fuel quantity, ignition timing, EGR, etc.) are predetermined and stored in a data memory, and in operation, said two sorts of parameters are detected to get the inputs to the data memory so that the required engine controlling factors may be read-out. (e.g., Japanese Patent Publication Ser. No. SHO 50-29098).

As is described above, PB input to the data memory has the following deficiency.

As is well known in this art, the PB decreases nearly exponentially with increasing engine load, starting from its light load (idle) operation down to heavy load operation, therefore the load variation produces a relatively large PB variation rate as long as the engine is operating with light load, so the precise and detailed engine control is achieved. The load variation, however, produces a small PB variation when the load becomes heavy, therefore the PB is no longer effective for a good control.

To overcome said deficiency, throttle valve opening angle θth may be used in place of PB. The parameter θth, being small while the engine is operating in no load condition, increases exponentially with increasing load. As a result, θth has another deficiency, i.e., an accurate and fine control of the engine can not be obtained in the light load range because of the small parameter variation with varying load, though it is possible in the heavy load range because of its great variation with load variation.

SUMMARY OF THE INVENTION

It is an object of this invention to provide an engine control system free from said deficiency and performing an accurate and fine engine control all over the range from very light load in idling condition to heavy load.

It is another object of this invention to provide an engine control system that can perform a suitable and fine engine control throughout the engine load range by using the engine control data consisting of the parameters ne and PB in light load condition and those consisting of ne and θth in heavy load condition.

It is still another object of this invention to provide an engine control system having a hysteresis characteristic in setting the parameter changing points at which the parameter PB is changed to the parameter θth, or vice versa, thereby preventing the surging effect caused by load variation and enabling smooth engine control.

It is a further object of this invention to provide an engine control system capable of determining the changing points very well by setting the points in response to the PB value in low engine speed range and to the θth in high engine speed range.

It is still a further object of this invention to provide an engine control system capable of carrying out more effective control by evaluating the magnitude of the control data output read-out of the data memory in response to the input parameters ne, PB and θth, that is, by reading-out the engine control data in response to parameters PB and ne in small data value range, and those in response to parameters θth and ne in large data value range.

DETAILED DESCRIPTION OF THE INVENTION

Figure 1:
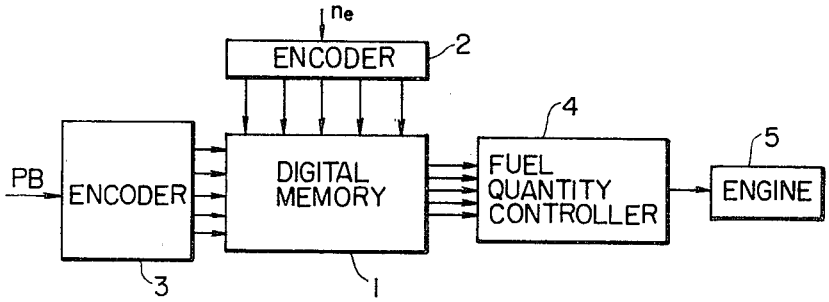
FIG. 1 (PRIOR ART)
FIG. 1 is a block diagram of a prior art electric engine control system.

Referring to the drawings, a detailed description of this invention will be made below. In the explanation below, an embodiment of this invention applied to air-fuel ratio controlling will be explained, but the invention is not restricted to the embodiment. It should be noticed that the invention can be applied to other engine control systems such as ignition timing and EGR.

FIG. 1 is a brief block diagram of the conventional engine control device mentioned above, wherein reference number 1 denotes a digital memory, 2 denotes an encoder of engine speed ne which is an input parameter to the digital memory 1, 3 denotes an encoder of intake manifold depression PB which is the other input parameter to the digital memory 1, and 4 denotes a device for controlling the fuel quantity supplied to the engine 5 by means of controlling the output data read-out of the digital memory in response to a combination of input ne and PB.

Figure 2:
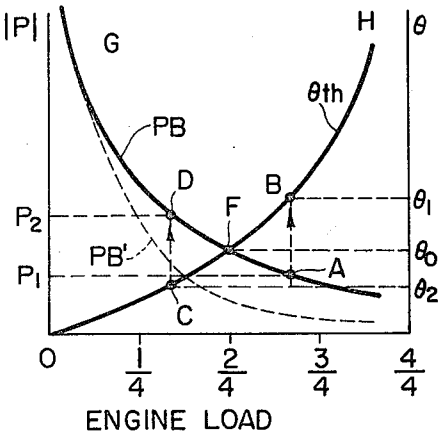
FIG. 2 is a drawing illustrating the relation between PB, θth and load.

FIG. 2 shows an example of how the PB and the θth change with the load starting from the idling condition (light load operation) and then gradually increasing up to the full load condition with the engine speed ne kept constant. As is obvious from the figure and the preceeding explanation, with the variation from no load to full load, the PB decreases approximately exponentially, while θth increases nearly exponentially.

Taking the above facts into consideration, in this invention, the parameter PB is adopted for light engine load and the parameter $\theta$th for the heavy engine load, so that engine control may be carried out with a large variation rate of parameters throughout the operating condition ranging from no load to full load.

Figure 3:
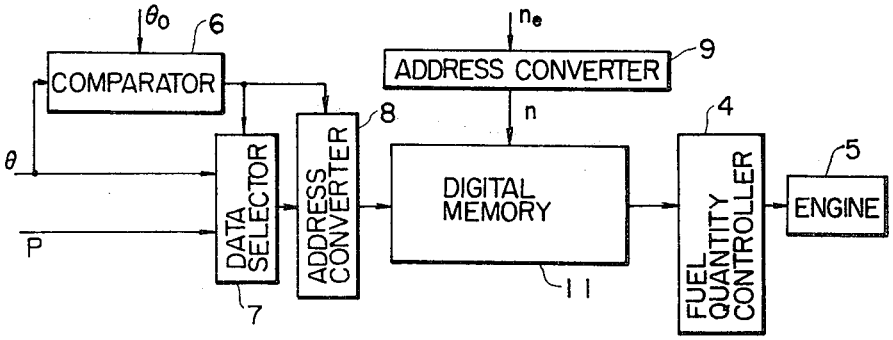
FIGS. 3,4,7,11 and 14 are block diagrams of the embodiments of this invention.

FIG. 3 is a block diagram of an embodiment of this invention, wherein the same or equivalent parts to those of FIG. 1 are denoted by the same reference numbers. The number 6 denotes a comparator which compares a detected value $\theta$ of $\theta$th with a predetermined value $\theta 0$. The output of the comparator 6 controls a data selector 7 and actuates an address converter 8 in a mode corresponding to the selected parameter (either one of PB or $\theta$th). The data selector 7, controlled by the comparator output 6, selects either PB or $\theta$th as an input parameter to the data memory 11, and 9 denotes an address converter for the input ne to said memory.

In operation, the detected value $\theta$ of $\theta$th is compared with a preset value (e.g., $\theta 0$ corresponding to the point F in FIG. 2) at the comparator 6. If the detected value $\theta$ is smaller than the preset value $\theta 0$, the comparator output commands the data selector 7 to select a value P of PB, so that the address converter 8 addresses the memory for PB mode operation. Consequently, the data memory 11 gives a control data derived from input parameters of said P and a detected value n of ne. Said data is fed to a controller 4 for proper control of engine 5.

When the parameter $\theta$th increases and the detected value $\theta$ of $\theta$th exceeds the preset value, the output of comparator 6 is reversed, the data selector 7 selecting $\theta$, and the address converter 8 designates an address suitable for $\theta$th mode. At that time, the data memory 11 gives a control data output derived from input parameters of n and $\theta$. Said control data is used to control the engine 5.

As is described above, according to this invention, a parameter having a large variation rate with respect to the load variation is always utilized, regardless of the magnitude of the engine load, therefore, much more accurate and fine engine control than the conventional one is achieved. It is easily understood that the changing point in said parameter changing control may be determined by using the detected value P of PB, and moreover it may be determined by using the detected value n of ne since the load—PB and load—$\theta$th characteristic curves are varied in dependence on ne.

The parameter changing based on a single predetermined value of the factors as $\theta$th, PB and ne, however, has such deficiency that a so-called surging phenomenon occurs easily caused by the load variation in the vicinity of the changing point, thereby introducing instability of engine control. To overcome this deficiency, it is better to give a hysteresis characteristic to the shifting of the parameter changing point.

As another embodiment of this invention, explanation will be made on the example of a parameter changing point whose locus has a hysteresis characteristic.

In FIG. 3, PB is selected as an input parameter because the value $\theta$ of $\theta$th is small in a light load condition such as an idle condition, and a combination of two parameters ne and PB is used to read-out control data from the data of digital memory 11.

In case the magnitude of engine load is increased from idle condition to full load condition, the value of PB increases along the characteristic curve (see FIG. 2), and when it reaches point A on the PB characteristic curve after passing the point F in FIG. 2 or in other words, when the $\theta$, gradually increasing from its zero value, reaches $\theta 1$, the parameter being adopted as an input is switched over from PB to $\theta$th, and the value $\theta 1$ at that time, together with detected value n of ne, is used to read-out the control data of digital memory 11.

That is, the data being adopted as the parameter is PB during the period that the operation point moves from G through F to A over the PB characteristic curve of FIG. 2. At point A, the parameter adopted becomes $\theta 1$ on the characteristic curve $\theta$th, and the subsequent parameter is $\theta$th during the period the operation point moves from B to H.

Conversely, in case the magnitude of the load is decreased to zero from its upper limit, it will be easily understood from above explanation that data adopted as the parameter moves from H through B and F to C along the characteristic curve $\theta$th in FIG. 2. When the value of $\theta$th reaches $\theta 2$ which is smaller than said $\theta 1$, the parameter is changed over from $\theta$th to PB.

Figure 4:
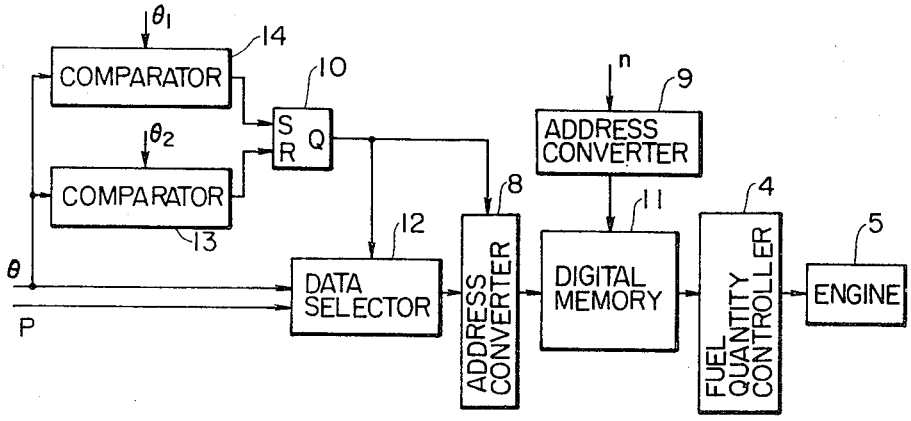

The control explained above can be practiced by using the system of FIG. 3, but the system of FIG. 4 may give a better example in which a surge preventive circuit is incorporated. In FIG. 4, reference number 10 denotes a flip-flop (represented by FF below), 12 denotes a data selector, 13 denotes a comparator for generating output "1" if $\theta 2 > \theta$, and 14 denotes another comparator for generating output "1" if $\theta > \theta 1$.

At the start of this system operation, the detected value of $\theta$th is fed to the comparators 13 and 14 for comparison. At that time, the $\theta$ is sufficiently small and comparator 13 gives an output "1" to reset FF 10 and the comparator 14 "0". Flip-flop FF 10 in its reset condition provides "0" at its output Q, instructing the data selector 12 to select a detected value P of PB, which is fed to an operational part or an address converter 8 so that it is used together with n for calculation or reading of the engine control data in similar manner to that described with reference to FIG. 3.

The $\theta$ increases with increasing engine load, and at the moment the condition $\theta > \theta 2$ is satisfied, the comparator 13 gives output "0", but output Q of FF 10 remains unchanged. Further increase of $\theta$ gives the condition $\theta > \theta 1$, therefore the comparator 14 gives output "1" to set FF 10. Consequently, FF 10 gives "1" at the output Q so that the data selector 12 selects the detected value $\theta$ of $\theta$th. Thus, the engine control data derived from parameters $\theta$ and n are read-out of the data memory 11.

Next, explanation will be made on an example in which the engine load decreases from its initial heavy load. When the decreasing $\theta$ arrives at $\theta 1$, the comparator 14 gives output "0" and then at $\theta 2$ the comparator 13 gives output "1". On arrival of $\theta$ at $\theta 2$ the comparator output resets FF 10 so that the data selector 12 may select P as a parameter. Thus, the desired hysteresis characteristic is achieved.

It is obvious that the above mentioned function will be executed by using a properly programmed computer. The operation in that case will be explained below referring to the flow chart of FIG. 5. The chart shows both the case when the engine load increases from zero to the upper limit and the case when the engine load decreases from the upper limit to zero.

First of all, a detected value $\theta$ of $\theta$th is taken into this system as a sensor signal at step S1. At step S2, the read sensor signal $\theta$ is judged if it is larger than the first preset value $\theta 1$. In the beginning, $\theta$ is smaller than $\theta 1$ because of the light load, so that the operation proceeds to step S3. Then, at step S3, $\theta$ is judged again to determine if it is larger than the second preset value $\theta 2$ (where $\theta 1 > \theta 2$). In the first judgement, the condition will not be satisfied and the process advances to step S4. At the step S4, flag is reset to Zero. At step S5, a detected value of PB corresponding to the load at that time is selected as the parameter.

A combination of PB and ne is used to read the necessary control data from the memory, and the read-out data is used by the controller for engine control. The sensor signal $\theta$ is read with certain intervals. And the process is a repetition of cycle S1-S2-S4-S5- . . . S1 for light load of engine.

With increasing load, the value $\theta$ increases and when it exceeds the second preset value $\theta 2$ the judgement condition of step S3 becomes satisfied. Due to this condition, the step advances from S3 to S6. At the step S6, a judgement is made about whether the flag is "1" or not. At that time, however, the flag will not be "1" and the process goes to step S5. The parameter selected is still PB, and hence the process repeats the cycle of S1-S2-S3-S6-S5 . . . S1.

Further increase of the engine load lets $\theta$ exceed $\theta 0$ represented by a point F in FIG. 2, and then exceed the first preset value $\theta 1$ so as to satisfy the judgement criterion of step S2. The process jumps from step S2 to S7 and rewrites the flag to "1", and parameter $\theta$th is selected in step S8. Later, necessary control data are read out of the memory in response to combinations of ne and $\theta$th between points B and H on the characteristic curve $\theta$th. These data are used by the controller for the engine control.

Next, explanation will be made of the case where the parameter $\theta$th is adopted and the load is declining. The detected value $\theta$ gradually decreases and firstly the judgement criterion of step S2 becomes invalid and then criterion of step S3 becomes valid. Thus, the processing cycle S1-S2-S3-S6-S8 with parameter $\theta$th is maintained.

Further decrease of the load makes the value $\theta$ smaller than the second preset value $\theta 2$, thereby making the condition of step S3 invalid. The process advances to step S4 and sets the flag "0". At step S5, parameter PB comes to be adopted.

The above mentioned process realizes the hysteresis characteristic in the locus of the parameter changing point movement, preventing the surging phenomenon that is likely to occur under a load fluctuation in the vicinity of the parameter changing point.

In the above description, an explanation was made of the case where the parameter changing point is set in dependence on the value $\theta$ of $\theta$th. It will be easily understood by persons having usual knowledge of this technological field that the same hysteresis characteristic will be obtained by substituting PB or ne for the input data to the comparator 6 of FIG. 3—comparators 13 and 14 of FIG. 4—or the sensor signal of FIG. 5 in case the changing point is determined on the basis of the intake manifold depression PB or the engine speed ne, and that preferably said first and second preset values are on the opposite sides of the point F in FIG. 2.

The above mentioned engine control system according to this invention realizes a stable and secure control. Especially in case of parameter changing in dependence upon $\theta$th, control performance is excellent at medium and high engine speed and in case of parameter changing in dependence upon PB, it is excellent at low and medium engine speed. In low-speed and heavy-load engine operation or in high speed engine operation, the characteristic curve PB is used in a gradually decreasing region, as shown by dotted curve PB' in FIG. 2, and the PB variation rate becomes very small with respect to the load variation, thereby deteriorating the control performance.

To overcome said disadvantage, in the embodiment of this invention explained below, the parameter changing point based on the detected value of $\theta$th is shifted toward the relatively lower load side in response to the engine speed ne so long as it is low, and toward the relatively higher load side when ne becomes high.

Figure 6:
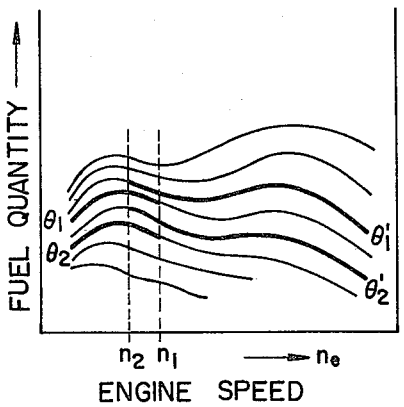
FIGS. 6 and 9 are drawings for use in explanation of how to set or correct the parameter changing point in response to ne.

FIG. 6 is a drawing illustrating a relation between the fuel quantity to be supplied and the engine speed ne with the parameter $\theta$th in the case where the control quantity is the fuel quantity to be supplied. It shows that the changing points $\theta 1$ and $\theta 2$ are relatively small in the range of low engine speed ne, but the changing points $\theta' 1$ and $\theta' 2$ are relatively large in the range of high engine speed. In this figure, relations $\theta' 1 > \theta 1$ and $\theta' 2 > \theta 2$ hold good.

Figure 7:
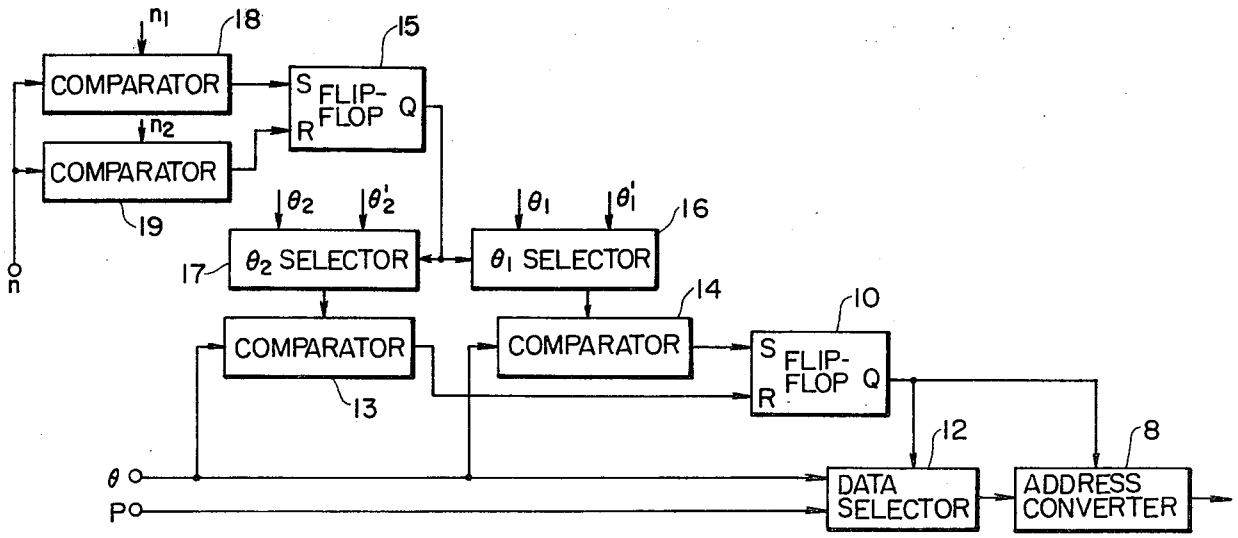

FIG. 7 is a block diagram of an embodiment of this invention capable of modifying the parameter changing points mentioned above. In FIG. 7, the same symbols as those in FIG. 4 denote the same or equivalent parts. The reference number 15 denotes FF, 16 denotes a $\theta 1$ selector, 17 denotes a $\theta 2$ selector, 18 denotes a comparator for providing output "1" if $n > n1$, and 19 denotes a comparator for providing output "1" if $n > n2$.

At the start of the system operation, the detected value n of the engine speed ne is fed to comparators 18 and 19 for comparison. At that time, n is smaller than both n1 and n2, therefore, the comparator 19 gives output "1", resetting FF 15. The resultant "0" at the output Q of FF 15 instructs the data selectors 16 and 17 to select $\theta 1$ and $\theta 2$ respectively. The selected values are fed to the comparators 14 and 13 as their preset values. It follows that the detected value $\theta$ of $\theta$th is fed to comparators 13 and 14 in order to realize the engine control with the parameter changing points of preset values $\theta 1$ and $\theta 2$ which creates a hysteresis characteristic of the parameter locus in the same way as described with reference to FIGS. 4 and 5.

When the increase of n gives a condition $n > n2$, the comparator 19 gives output "0" while output Q of FF 15 remains unchanged. Further increase of n provides the condition $n > n1$, the comparator 18 supplying output "1" and FF 15 being set. Consequently, the data selectors 16 and 17 respectively select $\theta' 1$ and $\theta' 2$, which are supplied to the comparators 14 and 13 as their preset values. Thus, in the range $n > n1$, an engine control is carried out with parameter changing points defined by preset values $\theta' 1$ and $\theta' 2$ whose movement has a hysteresis characteristic.

Next, condition $n > n1$ resulted from decreased n reverses the output of comparator 18 to "0" whilst output Q of FF 15 remains unchanged. Condition $n > n2$ resulted from further decrease of n turns the output of comparator 19 to "1", resetting FF 15 so that the data selectors 16 and 17 outputs $\theta 1$ and $\theta 2$ respectively.

Thus, the changing points of parameters $\theta$th and PB are moved in dependence upon ne, and the hysteresis characteristic in the movement gives a better control throughout the load range and all over the engine speed range. The surging phenomenon caused by the load fluctuation in the vicinity of the changing point is completely eliminated.

The shift of a parameter changing point using a computer will be explained with reference to the flow chart of FIG. 8. First of all, the detected values $\theta$ and n of $\theta$th and ne are read as sensor signals at step S10. At step S11, with respect to n out of the sensor signals read, validity of condition $n>n1$ is evaluated.

Figure 5:
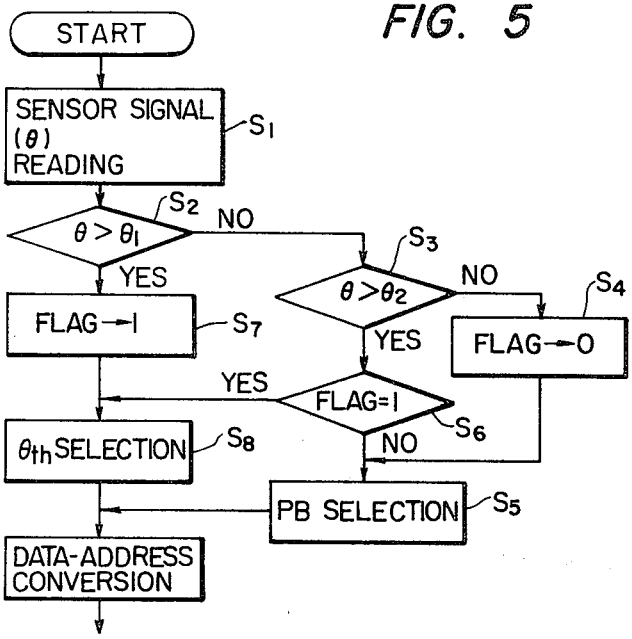
FIGS. 5, 8, 12 and 15 are flow-charts representing operation of the embodiment of this invention practiced using a computer.

In the beginning, engine speed is assumed to be sufficiently low. Said condition is invalid and the process advances to step S12 at which validity of condition $n>n2$ is judged. The judgement condition is also invalid at that time and the process advances to step S13 at which the flag A is reset to "0", then the process advances to step S14 at which a combination of preset values $\theta 1$ and $\theta 2$ is selected for parameter changing points. Later the process goes to step S2 at which the same parameter selection and changing as those described in relation with FIG. 5 are executed.

When the condition $n>n2$ becomes satisfied as a result of an increase of engine speed ne, the process advances from step S12 to step S15, but the combination of $\theta 1$ and $\theta 2$ is not changed because flag A indicates "0". In this condition, the process repeats the cycle of S10-S11-S12-S15-S14-S2- . . . -S10.

With the condition $n>n1$ resulting from further increase of engine speed ne, the process advances from step S11 to step S16, writing "1" in flag A. At step S17, a combination of $\theta'1$ and $\theta'2$ is selected as preset values for the parameter changing points. Subsequently, the parameter changing between $\theta$th and PB is carried out similarly with the criteria $\theta'1$ and $\theta'2$.

Next, an explanation will be made of the case where ne decreases, starting with the condition that $\theta'1$ and $\theta'2$ are selected as the preset values for the parameter changing points. In the beginning, the condition $n>n1$ is invalid and the condition $n>n2$ is valid. These conditions advance the process from S10 through S11, S12, S15 to S17, keeping the selection of $\theta'1$ and $\theta'2$. With the condition $n>n2$ now dissatisfied as the result of further decrease of ne, the flag A turns to "0" at step 13 and a combination of $\theta 1$ and $\theta 2$ is selected as the parameter changing points at step S14.

As is described above, in a relatively low ne range, parameter PB is changed to the parameter $\theta$th with its small preset values $\theta 1$ and $\theta 2$ of $\theta$th, but in high ne it is done with relatively large preset values $\theta'1$ and $\theta'2$ of $\theta$th, thus improving the control performance in low engine speed and heavy load.

As mentioned before in this specification, the shift and correction of parameter changing points by using ne, may find exactly the same manner of application in the parameter changing by using a detected value of PB. In the latter application, however, the parameter changing point must be shifted toward the heavy load side if ne is small, and toward the light load side if ne is large.

Figure 9:
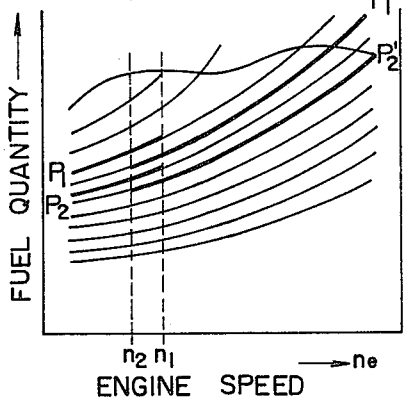

FIG. 9 shows an example of the change and correction of the parameter changing points in that case. The figure illustrates the relationship between ne and a fuel quantity to be supplied (i.e., engine control data) with the parameter of PB value, where P1, P2, P1' and P2' are all representing negative pressures. That is, $|P1|<|P1'|$, $|P2|<|P2'|$.

As is obvious from the figure, when ne is increasing, P1 and P2 are selected as the preset values of the parameter changing points between PB and $\theta$th if $n<n1$, and P1' and P2' are selected as the preset values of parameter changing points if $n>n1$. On the other hand, when ne is decreasing, the preset values to be selected for determining the parameter changing points are P1' and P2' for $n>n2$ and P1 and P2 for $n<n2$.

Figure 8:
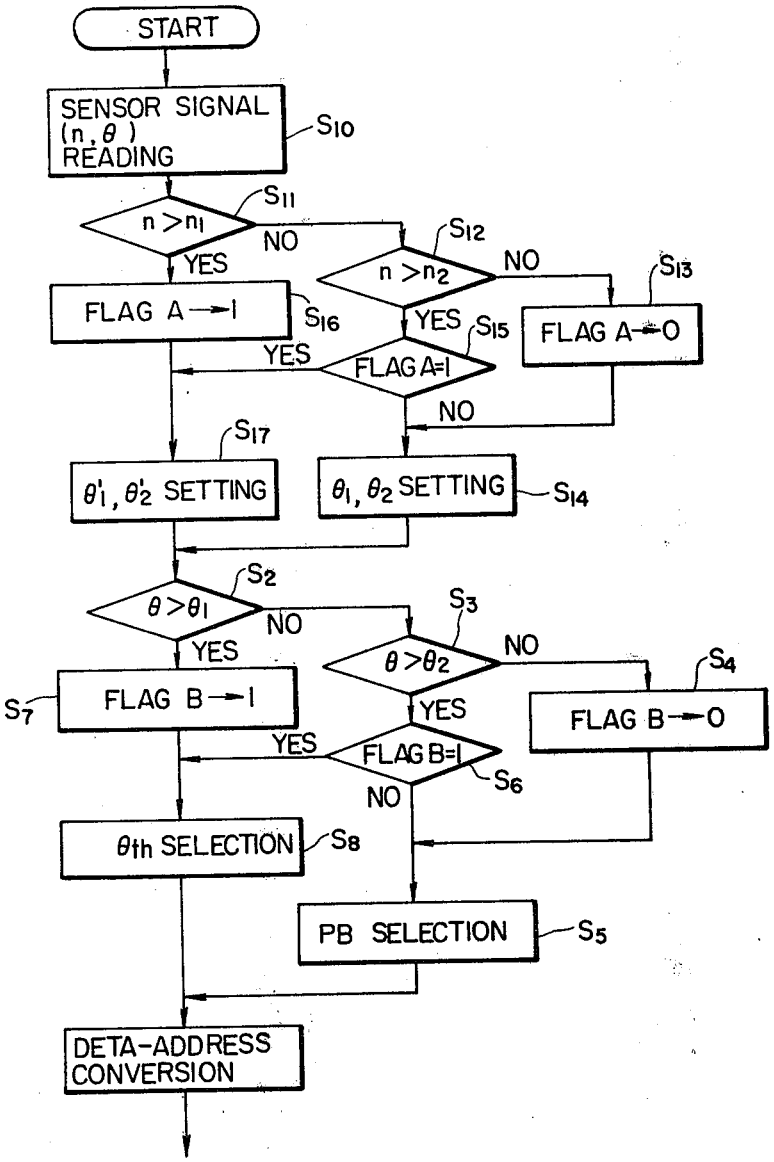

To execute the above mentioned control operation, P is adopted in place of sensor signal $\theta$ in FIG. 7 or FIG. 8, and this P is replaced by $\theta$.

It is already well known that a similar relationship to that between the engine load and PB, or engine load and $\theta$th described with respect to FIG. 2 exsists between ne and PB or ne and $\theta$th. That is, a stable and smooth engine control will be attained by changing the parameter PB to $\theta$th, or vice versa, in response to the engine speed ne, based on the value PB if ne is small and on the value $\theta$th if ne is large.

Figure 10:
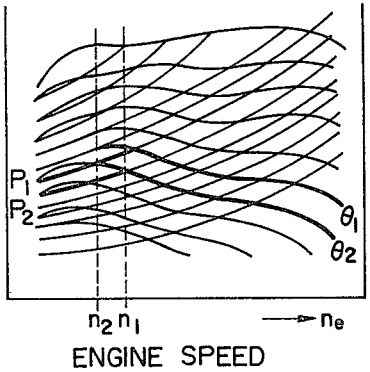
FIG. 10 is a drawing for use in explanation of how to set the position of the parameter changing point between PB and θth using the parameter ne.

Followings are an explanation of the operation in this case. FIG. 10 shows the condition. So long as ne is increasing, P1 and P2 of PB are selected as the reference values for parameter changing point determination in the range $n<n1$, and $\theta 1$ and $\theta 2$ of $\theta$th are selected as the reference values for parameter changing point determination in the range $n>n1$. Conversely, when ne is decreasing, the reference values to be selected for parameter changing point determination are $\theta$th ($\theta 1$, $\theta 2$) in the range $n>n2$ and PB (P1, P2) in the range $n<n2$.

Figure 11:
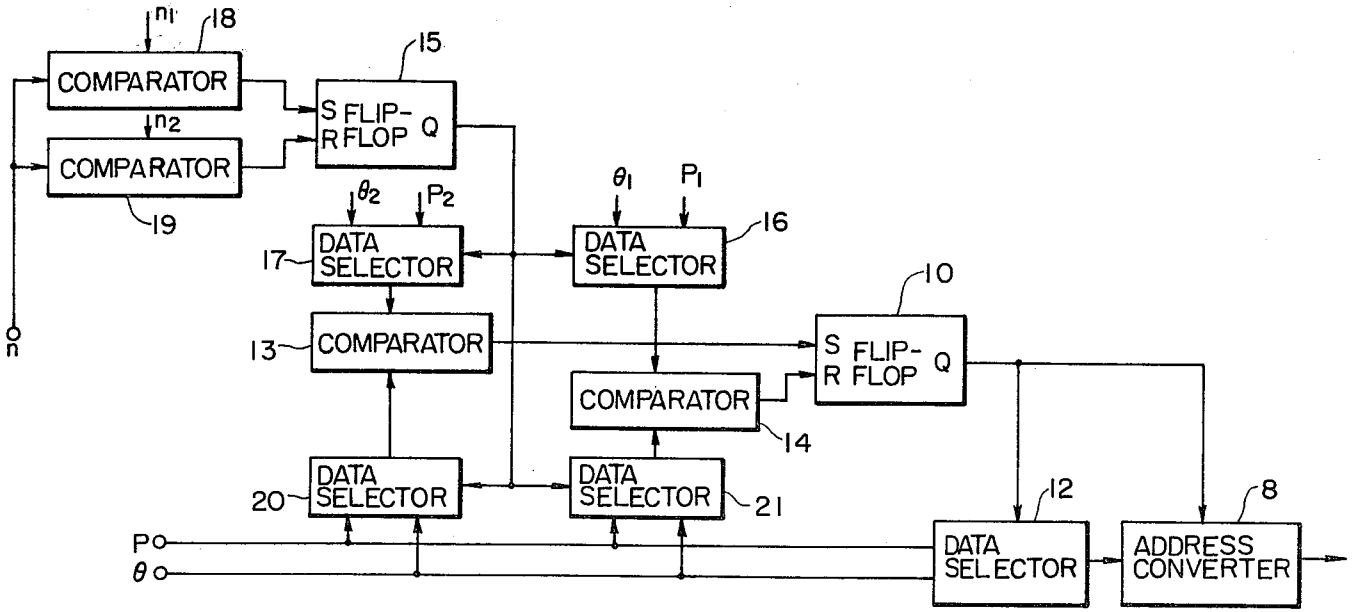

FIG. 11 shows an embodiment of this invention which carries out the same control of parameter changing points as in FIG. 10. In the figure, the same reference symbols indicate the same or equivalent parts to those in FIG. 7. The reference numbers 20 and 21 denote data selectors.

At the same time as the engine starts, the engine speed detected value n is fed to the comparators 18 and 19. Since this value n is smaller than both n1 and n2 in the beginning, comparator 19 gives output "1" and FF 15 is reset. Consequently, output Q of FF 15 is "0". The data selectors 16 and 17 respectively select and output P1 and P2, which are supplied to the comparators 14 and 13 as the preset values. At the same time, with the "0" output of FF 15, data selectors 20 and 21 select P's which are fed to the comparators 13 and 14, respectively.

It follows that the P's are compared with P1 and P2 at comparators 13 and 14, respectively. A control action having a hysteresis characteristic takes place with the preset values P1 and P2 for parameter changing points between PB and $\theta$th in the same manner as described previously.

When the increasing n brings about the condition $n>n2$, the output of comparator 19 becomes "0", but the output Q of FF 15 remains unchanged. When further increase of n brings about the condition $n>n1$, the output of comparator 18 becomes "1" and FF 15 is set. In this condition, the data selectors 16 and 17 respectively select and output $\theta 1$ and $\theta 2$ which are supplied to the comparators 14 and 13 as their preset values. On the other hand, the data selectors 20 and 21 output $\theta$'s. Therefore, in the range $n>n1$, a control with hysteresis characteristic is carried out with the parameter changing points of preset values $\theta 1$ and $\theta 2$.

When the decreasing n brings about the condition $n<n1$, the output of comparator 18 turns to "0", but the output Q of FF 15 remains unchanged. When further decrement of n brings about the condition $n<n2$, the output of comparator 19 turns to "1" and FF 15 is reset, the data selectors 16 and 17 giving outputs P1 and P2, data selectors 20 and 21 selecting P.

Thus, an extremely stable and smooth engine control is attained by the substitution of PB with $\theta$th, or vice versa, so that the control is carried out based on PB for small ne and on θth for large ne.

Figure 12:
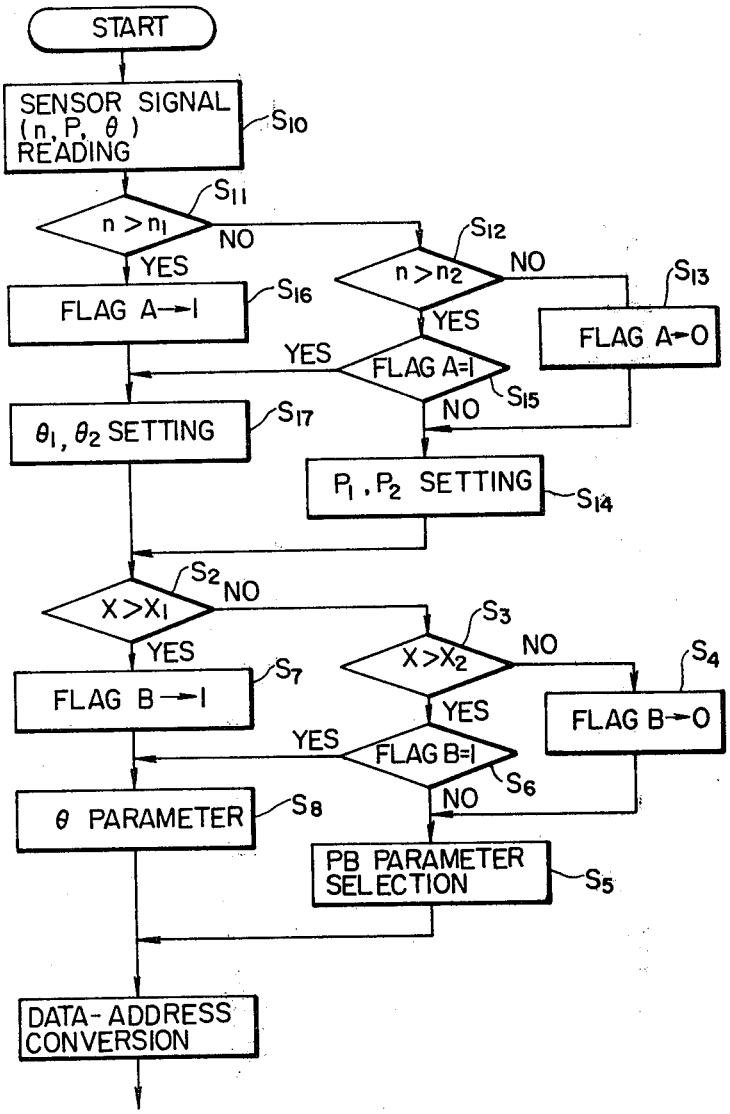

Referring now to the flow chart of FIG. 12, the computer simulation with which parameter changing points are controlled in a manner similar to that of FIG. 11 will be explained.

First, detected values P, θ and n of PB, θth and ne are read as sensor signals (step S10). In step S11, validity of the condition n=n1 with respect to n out of the read sensor signals is judged. Because of the low engine speed, this condition is invalid in the beginning. The control advances to step S12 at which judgement of condition n>n2 is executed, where the judgement condition is not satisfied, and the process advances to step S13.

The flag A is reset to "0" at the step S13. The process then advances to step S14 at which a combination of P1 and P2 is selected as the preset values of parameter changing points. Later, the process advances to step S2 and, as was described with reference to FIG. 5, parameter selection and changing one to the other between PB and θth are executed based on P1 and P2.

With the condition n>n2 brought about by the increasing engine speed ne, the process advances from step S12 to S15, the flag A now indicates "0", therefore, the setting of P1 and P2 is not changed. In this condition, the process is a repetition of cycle S10-S11-S12-S15-S14-S2-. . . -S10.

With the condition n>n1 introduced by further increment of engine speed ne, the process advances from step S16 and the flag A is turned to "1". At step S17, a combination of θ1 and θ2 is selected as the preset values for parameter changing points. Subsequently, parameter changing between θth and PB is carried out based on θ1 and θ2 in the same manner as described above.

Next, explanation will be made of the case where ne decreases, starting with the condition that the preset values of θ1 and θ2 are selected for the parameter changing points. In the beginning, the condition n>n1 is not satisfied but the condition n>n2 is satisfied. Therefore, the process advances in the order of S10-S11-S12-S15-S17, but the parameter changing point preset values are still a combination of θ1 and θ2. When further decrement of ne begins to dissatisfy the condition n>n2, the flag A turns to "0" at step S13 and P1 and P2 are selected as the preset values for the parameter changing points at step S14.

In the manner described above, the parameter changing points are set up on the basis of PB in the relatively lower ne range and on the basis of θth in the relatively higher ne range, securing a stable and smooth engine control performance.

In the above description, explanation was made about the embodiment in which the setting of parameter changing point in accordance with ne value as well the setting of the parameter changing between PB and θth on the basis of the preset value PB or θth have the hysteresis characteristics. However, it should be understood that one or both of the said hysteresis characteristics may be omitted.

Figure 13:
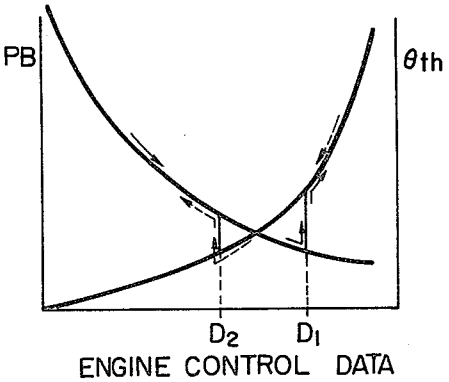
FIG. 13 is a drawing illustrating the relationship between the engine control data and PB and θth.

Furthermore, it is known that the engine also has a similar relation to that shown in FIG. 2 between PB or θth and the engine control data (quantity of supplied fuel, ignition timing, EGR control quantity). In other words, as shown in FIG. 13, with increasing engine control data (abscissa), the PB decreases exponentially, while the θth increases exponentially. The parameter transformation from PB to θth, or vice versa, may be judged in response to the magnitude of the engine control data read out of the memory. Operation in this case will be explained below.

The arrows of FIG. 13 indicate the said situation. If the control data is increasing during the engine operation, (i.e., the engine load is on its increment), the parameter for the control data reading is a detected value of PB in the range D<D1 and is a detected value of θth in the range D>D1. Namely, the operation point is moved in the direction of full line arrow.

If the control data is decreasing (i.e., the engine load is on its decrement), the parameter to be adopted is a detected value θth in the range D>D2 (where D2<D1) and is a detected value of PB in the range D<D2. Namely, the operation point is moved in the direction of the dotted line arrow.

Figure 14:
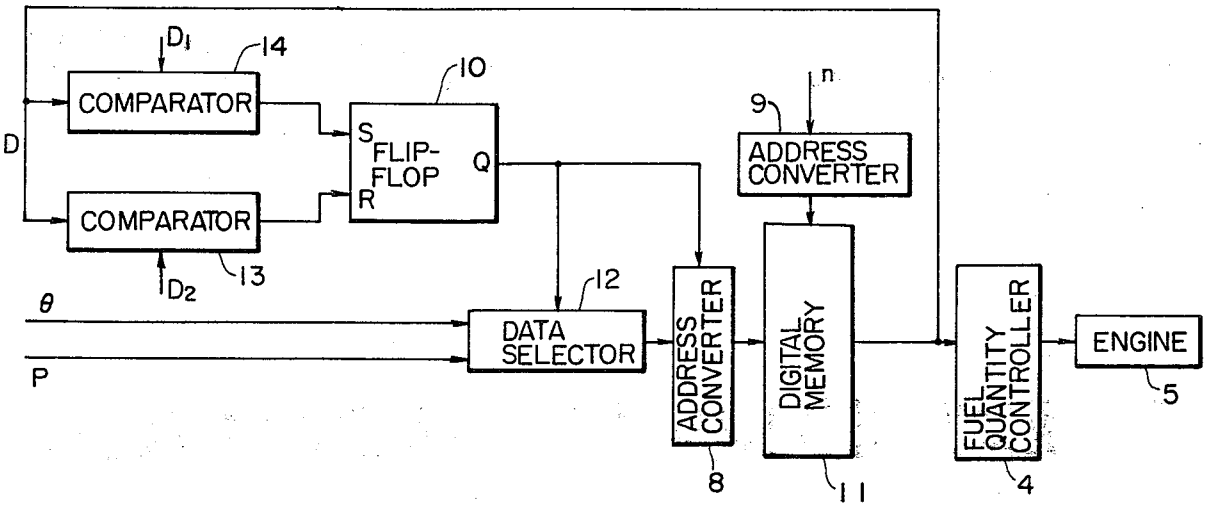

FIG. 14 shows an embodiment of this invention which carries out the parameter changing control shown in FIG. 13. The same reference symbols as those in FIG. 4 indicate the same or equivalent parts. A comparison with FIG. 4 clearly shows that the sole difference is that the read-out data D is adopted in place of θth in FIG. 4, which is supplied to the comparators 13 and 14. The others are the same.

First, the data D (in this example, fuel quantity to be supplied) read out of the data (digital) memory 11 are fed to the comparators 13 and 14 for comparison with their preset values D1 and D2. For sufficiently small D, comparator 13 gives output "1", comparator 14 output "0", resetting FF 10 whose output Q turns to "0". The data selector 12, therefore, selects a detected value P of PB and send it out. The output of the data selector 12 is fed to an operational part or address converter 8, and together with the detected value n of ne, is used for reading or computing the engine control data.

The data D increases with increasing load and at the moment it comes to satisfy the condition D>D2, the comparator 13 gives output "0" whereas the output Q of FF 10 remains unchanged. Further increase of the load brings about the condition D>D1, so that the comparator 14 gives output "1", which turns FF 10 into its set condition. The "1" at the output Q of FF 10 instructs the data selector 12 to select and output the detected value θ of θth. With parameters θ and n, the data (digital) memory 11 provides data that will be used for controlling the engine 5.

Next, an explanation will be made on a case that the engine load decreases where the initial condition is that the selected data reading parameter is θ and heavy load is imposed. The decreasing D lets the comparator 14 give output "0" at D1 and then lets the comparator 13 give output "1" at D2. Therefore, when the D reaches D2, FF 10 is turned into its reset state, and the data selector 12 comes to select P. Thus, PB-θth parameter changing operation having a desirable hysteresis characteristic is achieved.

As is described above, the parameter replacement control between PB and θth using the read-out data D gives more rational and stable control throughout the overall engine speed range and load range.

Figure 15:
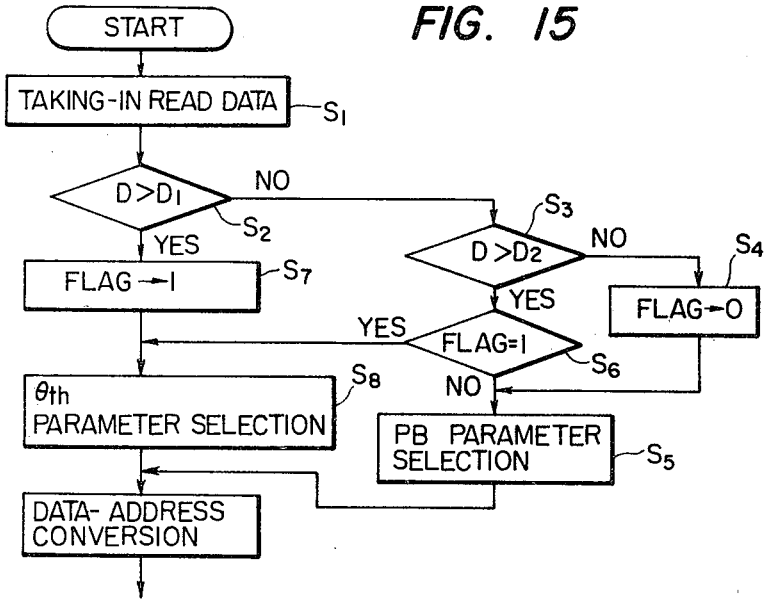

As is obvious to persons skilled in this art, similar control can be practiced by using a computer. A flow chart of the computer processing is given in FIG. 15.

First, the value D read out of the data memory is employed as the sensor signal at step S1. At step S2, the sensor signal D is judged if it is larger than the first preset value D1. As the read-out data value D is smaller than D1 in the beginning, the process advances to step S3 at which it is judged if it is larger than the second preset value D2. This judgement condition is not satisfied in the beginning, therefore, the process advances to step S4.

In this step, the flag is reset to "0". The process advances to step S5. The parameter selected is the PB corresponding to the engine load at that time. In response to a combination of the PB and the ne, necessary control data is read out of the data memory. Using the data readout, the controller executes the engine control. The sensor signal D is taken into the present system with a proper interval. So long as D is small, the process is the repetition of cycle S1-S2-S3-S4-S5- . . . -S1.

When the increasing D exceeds the second preset value D2, the judgement condition at step S3 becomes satisfied. With this condition, the process advances from step S3 to step S6. In this step, the flag is checked if it is "1" or not. The flag, however, is not "1" at that time yet, therefore, the process goes to step S5. The parameter to be selected is still PB. In this condition the process is repeated in the order of S1-S2-S3-S6-S5- . . . -S1.

When further increase of D exceeds the first preset value D1, the judgement condition at step S2 is satisfied, the process advances to step S7 and turns the flag to "1". At step S8, the parameter to be selected is $\theta$th. Later, a combination of the detected value $\theta$ of $\theta$th and the detected value n of ne is used to read necessary control data D from the data or digital memory. This data is fed to the controller for engine control.

In case D decreases, starting from its initial condition that $\theta$th is used as the parameter, the judgement condition at step S2 is dissatisfied and the condition at step S3 is satisfied in the beginning. The process advances in the order of S1-S2-S3-S6-S8. The parameter adopted is still $\theta$th. When further decreasing D becomes smaller than the second preset value D2, the judgement condition at step S3 is also dissatisfied, therefore, the process advances to step S4, turning the flag to "0". At step S5, PB is adopted as the parameter.

It should be noticed that the locus specified by the parameter changing points between PB and $\theta$th has a hysteresis characteristic in above example, but it does not always need to have this characteristic.

What is claimed is:

1. An engine control system comprising;
means for storing engine control data with the parameters throttle valve opening angle for regulating the quantity of air to be taken into an engine, the intake manifold depression and the engine speed,
means for reading-out said engine control data with the parameters of intake manifold depression and engine speed in light load condition and with the parameters of throttle valve opening angle and engine speed in heavy load condition, and
means for controlling the engine using the read-out data.

2. An engine control system according to claim 1, wherein the point at which the parameter is changed from the intake manifold depression to the throttle valve opening angle, or vice versa, is determined by either of the throttle valve opening angle and the intake manifold depression.

3. An engine control system comprising:
means for storing engine control data with the parameters throttle valve opening angle, the intake manifold depression and the engine speed,
means for reading-out the engine control data with parameters of intake manifold depression and engine speed in light load condition and with the parameters of throttle valve opening angle and engine speed in heavy load condition, and
means for controlling the engine using the read-out data, wherein a hysteresis characteristic is given to the locus of the point where the parameter is changed from the intake manifold depression to the throttle valve opening angle, or vice versa.

4. An engine control system according to claim 3, wherein the point at which the parameter is changed from the intake manifold depression to the throttle valve opening angle, or vice versa, is determined by either of the throttle valve opening angle or the intake manifold depression.

5. An engine control system comprising:
means for storing engine control data with the parameters throttle valve opening angle, the intake manifold depression and the engine speed,
means for reading-out the engine control data with the parameters of intake manifold depression and the engine speed in light load condition and with the throttle valve opening angle and the engine speed in heavy load condition,
means for determining the point where the parameter is changed from the intake manifold depression to the throttle valve opening angle, or vice versa, on the basis of the value of the throttle valve opening angle,
means for shifting the said parameter changing point in response to the engine speed in such manner as to shift the point toward light load side if the engine speed is low and toward heavy load side if it is high, and
means for controlling the engine using the read-out data.

6. An engine control system according to claim 5 wherein a hysteresis characteristic is given to the locus of the point where the parameter is changed from the intake manifold depression to the throttle valve opening angle, or vice versa.

7. An engine control system according to claim 5, wherein a hysteresis characteristic is given to the locus of the shifting of the parameter changing point in response to the engine speed.

8. An engine control system according to claim 6, wherein a hysteresis characteristic is given to the locus of the shifting of the parameter changing point in response to the engine speed.

9. An engine control system comprising:
means for storing engine control data with the parameters throttle valve opening angle, the intake manifold depression and the engine speed,
means for reading-out the engine control data with the parameters of the intake manifold depression and the engine speed in light load condition and with the throttle valve opening angle and the engine speed in heavy load condition,
means for determining the point where the parameter is changed from the intake manifold depression to the throttle valve opening angle, or vice versa, on the basis of the value of the intake manifold depression,
means for shifting said parameter changing point in response to the engine speed in such manner as to shift the point toward light load side while the engine speed is decreasing from high to low, and toward heavy load side while the engine speed is increasing from low to high, and means for controlling the engine using the read-out data.

10. An engine control system according to claim 9, wherein a hysteresis characteristic is given to the locus of the point where the parameter is changed from the intake manifold depression to the throttle valve opening angle, or vice versa.

11. An engine control system according to claim 9, wherein a hysteresis characteristic is given to the locus of the shifting of the parameter changing point in response to the engine speed.

12. An engine control system according to claim 10, wherein a hysteresis characteristic is given to the locus of the shifting of the parameter changing point in response to the engine speed.

13. An engine control system comprising:

means for storing engine control data with the parameters of the throttle valve opening angle, the intake manifold depression and the engine speed, means for reading-out the engine control data with the parameters of the intake manifold depression and the engine speed in light load condition and with the throttle valve opening angle and the engine speed in heavy load condition and means for determining the point where the parameter is changed from the intake manifold depression to the throttle valve opening angle, or vice versa, in response to the value of the intake manifold depression in lower engine speed range and in response to the value of the throttle valve opening angle in higher engine speed range.

14. An engine control system according to claim 13, wherein a hysteresis characteristic is given to the locus of the point where the parameter is changed from the intake manifold depression to the throttle valve opening angle, or vice versa.

15. An engine control system according to claim 13 wherein a hysteresis characteristic is given to the locus of the parameter changing for setting the parameter changing point in response to the engine speed.

16. An engine control system according to claim 14, wherein a hysteresis characteristic is given to the locus of the parameter changing for setting the parameter changing point in response to the engine speed.

17. An engine control system comprising:

means for storing engine control data with the parameters of the throttle valve opening angle, the intake manifold depression and the engine speed, means for reading-out the engine control data with the parameters of the intake manifold depression and the engine speed in light load condition and with the throttle valve opening angle and the engine speed in heavy load condition, means for changing the parameter from the intake manifold depression to the throttle valve opening angle, or vice versa, in response to the value of the engine control data, and means for controlling the engine using the read-out data.

18. An engine control system according to claim 17, wherein a hysteresis characteristic is given to the locus of the point where the parameter is changed from the intake manifold depression to the throttle valve opening angle, or vice versa.

* * * * *